US006763621B1

(12) United States Patent
Felsenthal et al.

(10) Patent No.: US 6,763,621 B1
(45) Date of Patent: Jul. 20, 2004

(54) UNIVERSAL IRONING BOARD COVER WITH UNIVERSAL TENSIONING SYSTEM & DUAL NOSE POCKET

(76) Inventors: Sandy A. Felsenthal, 5428 Collingwood Cove, Memphis, TN (US) 38117; Peter S. Felsenthal, 2340 Kirby Woods Cove, Memphis, TN (US) 38119

( * ) Notice: Subject to any disclaimer, the term of this patent is extended or adjusted under 35 U.S.C. 154(b) by 0 days.

(21) Appl. No.: 10/372,785

(22) Filed: Feb. 26, 2003

(51) Int. Cl.[7] ..... D06F 83/00
(52) U.S. Cl. ..... 38/140
(58) Field of Search ..... 38/66, 137, 140; 150/154, 158, 164, 165

(56) References Cited

U.S. PATENT DOCUMENTS

| | | | | | |
|---|---|---|---|---|---|
| 457,033 | A | * | 8/1891 | Sanders | 38/140 |
| 1,832,545 | A | * | 11/1931 | Grant | 38/140 |
| 1,881,977 | A | | 10/1932 | Sundby | |
| 2,026,961 | A | * | 1/1936 | Brodt | 38/140 |
| 2,031,595 | A | | 2/1936 | Finck | |
| 2,179,458 | A | * | 11/1939 | Ruttenberg | 38/140 |
| 2,264,644 | A | * | 12/1941 | Santangelo | 38/66 |
| 2,269,804 | A | | 1/1942 | Allaback | |
| 2,711,601 | A | * | 6/1955 | Lehrman | 38/140 |
| 3,007,267 | A | | 11/1961 | Goldsmith | |
| 3,911,603 | A | | 10/1975 | Lehaman | |
| 4,557,062 | A | | 12/1985 | Mattesky | |
| 4,982,516 | A | | 1/1991 | Cervantes | |
| 5,231,777 | A | | 8/1993 | Mattesky | |
| 5,392,543 | A | * | 2/1995 | Lehrman | 38/140 |
| 5,497,570 | A | | 3/1996 | Burshaw et al. | |
| 6,233,854 | B1 | | 5/2001 | Levy | |

* cited by examiner

*Primary Examiner*—Ismael Izaguirre
(74) *Attorney, Agent, or Firm*—William D. Breneman; Todd A. Vaugh; Peter J. Georges

(57) ABSTRACT

A universal ironing board cover is provided having two separate and independent anchoring systems for anchoring the ironing board cover to the ironing board and a multi-functional nose pocket. The first independent anchoring system includes an independent drawstring for tensioning the ironing board cover to the ironing board, while the second independent anchoring system includes a plurality of alternative openings in at least two independent straps for engaging the plurality of alternative openings and anchoring the ironing board cover to the ironing board to accommodate a variety of shapes, configurations and mechanical arrangements for the support structure of the ironing board.

21 Claims, 7 Drawing Sheets

UNIVERSAL IRONING BOARD COVER WITH UNIVERSAL TENSIONING SYSTEM & DUAL NOSE POCKET

BACKGROUND OF THE INVENTION (1) Field of the Invention

The invention pertains to a universal ironing board cover with two independent tensioning systems for accommodating ironing boards of a variety of shapes and configurations. The first independent tensioning system of the novel universal ironing board cover is a drawstring disposed around the perimeter of the ironing board cover. The second independent tensioning system for the novel universal ironing board cover has a plurality of side openings in combination with a pair of independent tensioning straps for engaging the pair of plurality of openings at desired locations along the perimeter of the ironing board cover.

The novel universal ironing board cover further includes a multifunctional dual nose pocket which can be utilized for either accommodating an ironing board nose of different sized and configurations and assist in anchoring the cover to the ironing board or can be utilized in the anchoring of the pad of varying sizes when sewn into the ironing board cover or for securely engaging the ironing board pad when the pad is not sewn to the cover while the securely engaging the nose of ironing board. The dual nose pocket together with the novel universal tensioning system provides a secure engagement for ironing board covers of a variety of configurations and design while accommodating variations in the placement of support structures and mechanisms for providing for the adjustment and operation of the support structure along side the bottom of the typical ironing board.

(2) Description of the Related Art Including Information Disclosed Under 37 CFR 1.97 and 1.98

The prior art includes a wide variety of ironing boards of different designs, dimensions and configurations, as well as ironing board covers of various designs adapted to fit one or more of varying types of ironing boards typically in use. The typical ironing board is of a substantially rectangular configuration having a tapered end or nose. The length, width and degree of taper of the nose varies among commercially available ironing boards. The tapered end or nose is tapered to accommodate the ironing of cylindrical objects, such as sleeves, trouser legs and dresses which are typically threaded over the tapered nose which provides the support for ironing the cylindrical article. The degree of taper of the ironing and the point on which the tapered nose or tapered end begins is a matter of design in the ironing board manufacturing art, as well as consumer preference for the particular type of taper provided for the typical ironing board.

The size, shape and configuration of the ironing board and, particularly, the taper of the nose has created problems in providing a cover for covering the ironing board and has resulted in a number of types of ironing board covers and designs for strapping, lacing, tying or otherwise firmly fixing the ironing board cover. The shape and design of the traditional ironing board has also resulted in securement problems with the traditional ironing pad and has resulted in pads and covers that fit one particular type or design of ironing board better than other types of ironing boards due to a number of factors, the most important of which involve not only the configuration of the ironing board but also the arrangement of the pivoting support structure, as well as the mechanisms for adjusting the position of the support structure.

The prior art ironing board covers have been manufactured to accommodate one or more designs for ironing boards having a particular arrangement of folding legs and nose configuration. For example, one type of folding ironing board is described in Goldsmith U.S. Pat. No. 3,007,267, which provides for an ironing board cover having a pair of legs disposed substantially perpendicular to the planar surface of the ironing board and a pair of support legs pivotally crossing between the back end of the ironing board and the nose of the ironing board. Obviously, in fitting the ironing board cover in U.S. Pat. No. 3,007,267, the elastic tie band for fixing the ironing board cover to the ironing board cannot interfere with the position of the support legs or the position of the mechanism for activating the folding legs of the ironing board.

Similarly, prior art ironing board covers, such as Santangelo U.S. Pat. No. 2,264,644, which provide for a plurality of openings along the periphery of the ironing board cover and a crosstie support system are illustrated without reference to a particular type of ironing board in which the folding support system, as well as the mechanism for adjusting the position of the folding support is not illustrated. As a result, the applicability and use of an ironing board cover, such as shown in U.S. Pat. No. 2,264,644, is limited to applications where the predetermined openings and straps for interconnecting the predetermined openings do not interfere with the existing support structure as well as mechanisms for adjusting the support structure and, as a result, such an ironing board cover does not provide for a universal application to all types and shapes of ironing board covers. The same is true with regard to Sundby U.S. Pat. No. 1,881,977, which provides for an ironing board cover having a tapered nose in which rear cleat for the legs is positioned at the far back end of the ironing board. As a result the ironing board cover has an open back end to accommodate the rear cleat and does not have two independent tensioning systems.

Other prior art, such as Allaback U.S. Pat. No. 2,269,804, provide a securing system, which provides for the threading of the drawstring through a plurality of holes disposed adjacent to the drawstring and utilizing a hook having a spring to tension the drawstring to the ironing board. U.S. Pat. No. 2,269,804 does not provide a universal ironing board cover for accommodating the variety of ironing boards, shapes and sizes irrespective of the placement of the support structure and means for activation of the support structure and does not employ two separate independent tensioning systems.

Lehrman U.S. Pat. No. 5,392,543 provides a tensioning strap for engaging and tensioning the drawstring around the ironing board. U.S. Pat. No. 5,392,543 is not a universal tensioning system since it does not provide a plurality of alternative openings disposed along the perimeter of the ironing board and does not provide for the alternative engagement of those plurality of openings dependant upon size, shape and configuration of the ironing board.

Further, none of the prior art provides for a multifunctional dual nose cover that can be used for accommodating ironing boards having noses of different taper and width, as well as accommodating ironing pads of different size and configuration. In addition, the multifunctional dual nose cover can be employed to securely position the ironing board pads of varying widths with respect to the cover for sewing the ironing board cover to the pad. The novel dual nose pocket may also be employed to engage securely the nose of ironing board and for securely anchoring dual nose pocket to the ironing board utilizing a drawstring. The novel multifunctional dual nose cover utilizes an inner and outer pocket that can be used not only accommodating ironing boards of different sizes and shapes, but also can be utilized for engaging the ironing board pad which may be utilized to either accommodate pads of different widths or to assist in affixing the ironing board pad to the ironing board cover while providing the same or an alternative pocket for anchoring the ironing board cover to the ironing board with a universal tensioning system providing for alternative tensioning points for accommodating a variety of ironing board configurations and designs.

The prior art has not provided a universal ironing board cover for anchoring the ironing board pad and ironing board cover to an ironing board irrespective of the size, shape and configuration of the ironing board by providing a multifunctional dual nose cover to assist in not only accommodating pads of different sizes, but also ironing boards of different shapes and configurations to assist in fixing the ironing board pad to the nose of the ironing board while providing for a plurality of openings around the periphery of the ironing board cover which may be engaged through a plurality of alternative laterally disposed anchoring points utilizing a pair of independent tensioning straps which may be placed at alternative locations along the underside of the ironing board to tension the ironing board cover to the ironing board.

SUMMARY OF THE INVENTION

The invention provides a novel universal ironing board cover capable of accommodating a variety of shapes, sizes and configurations for an ironing board and securely anchoring the ironing board cover to the ironing board to maintain the position of the ironing board cover on the ironing board utilizing two independent tensioning systems. In a further embodiment of the invention, a dual nose pocket having an inner and outer pocket is provided for receiving the nose of the ironing board pad and fixing the position of the nose of the ironing board pad to the ironing board nose and providing a universal tensioning system for tensioning the anchored nose pad to the ironing board and providing a universal tensioning system for anchoring the ironing board cover to the ironing board irrespective of the position of the support mechanisms and mechanisms for activating and adjusting the position of the ironing board support system. This is achieved by utilizing a plurality of alternative openings for engagement by at least two independently placeable tensioning straps.

The invention achieves its advantages by employing a fabric body conforming substantially to the shape of an ironing board having at one end a tapered portion for receiving the nose of an ironing board. The ironing board cover includes a first independent tensioning system which preferably is a drawstring sewn into the channel provided by a pocket sewn around the periphery of the ironing board cover designed to contain a drawstring which may be either an elastic or non-elastic cord disposed within the channel. The second independent tensioning system is a plurality of alternative paired openings or slots provided adjacent to the drawstring for receiving a pair of independently placeable tensioning straps or connectors that may be used to tension a pair of openings at various desired locations along the length of the novel ironing board cover. The tensioning straps and slots or openings may be disposed inside or outside the perimeter of the tensioning drawstring and the tensioning straps may be adjusted to firmly secure the ironing board cover to the ironing board at various positions as may be selected by the user so as to not interfere with the ironing board support mechanism or adjustment mechanism and provide an accommodation for a variety of ironing board shapes and designs as well as the placement of the support structure (legs) on the ironing board as well as the placement of the mechanism for activating and adjusting the position of the legs.

The novel ironing board cover further provides for a novel multifunctional dual nose pocket to assist in anchoring the cover of an ironing board utilizing either an inner pocket of the ironing board cover or an outer pocket of the ironing board cover to accommodate either or both the pad or nose of the ironing board depending upon size and configuration. The novel multifunctional dual nose pocket further cooperates with the two independent tensioning systems to securely attach the novel ironing board cover to the ironing board. In the preferred embodiment ironing board pads and ironing board covers are sewn together as a unit. In this preferred application the inner and outer pockets serve to anchor and position pads of varying sizes, shapes and widths before the pad and cover are sewn together. When the inner pocket does not accommodate the ironing board pad, the novel ironing board cover further allows for the anchoring of an optional ironing board pad in the outer pocket of the ironing board cover. In this configuration the inner pocket remains empty and is then drawn tightly around the ironing board when the unit is fitted to the board. This advantage of the novel ironing board cover having two nose pockets may be achieved with or without the novel two independent tensioning systems.

The objects of the invention include the provision for a universal ironing board cover for accommodating a variety of ironing board shapes, sizes and designs with a variety of support systems and a variety of support adjustment systems by utilizing an ironing board cover having a first independent tensioning system such as a drawstring disposed intermediate the periphery of the ironing board cover and the second independent tensioning system composed of a plurality of alternative openings for receiving the pair of independently placeable tensioning straps for tensioning the ironing board cover to the ironing board. A further object of the invention is to provide two independent tensioning systems for anchoring the ironing board cover to the ironing board by providing a tensioning drawstring and a pair of independent tensioning straps that may be placed at various locations around the perimeter of the ironing board cover.

A further object of the invention is to provide a universal ironing board cover having an inner and outer nose pocket for receiving and anchoring the ironing board pad with respect to the ironing board cover. A further object of the invention is to provide a universal ironing board cover for anchoring not only the nose pad within a nose pocket, but also to anchor the ironing board cover and ironing board pad to the ironing board by utilizing two independent anchoring systems; the first independent anchoring system is preferably a tensionable drawstring for tensioning the ironing board cover to the ironing board and the second anchoring system is a plurality of independent tensioning straps which may be placed at various locations around the periphery of the novel ironing board cover. This is achieved by utilizing a plurality of alternative opening disposed around the periphery of the ironing board cover.

BRIEF DESCRIPTION OF THE SEVERAL VIEWS OF THE DRAWINGS

The objects and advantages will become apparent to those skilled in the art from the following detailed description of the invention in relation to the accompanying drawings in which.

DETAILED DESCRIPTION OF THE INVENTION

Figure 1:
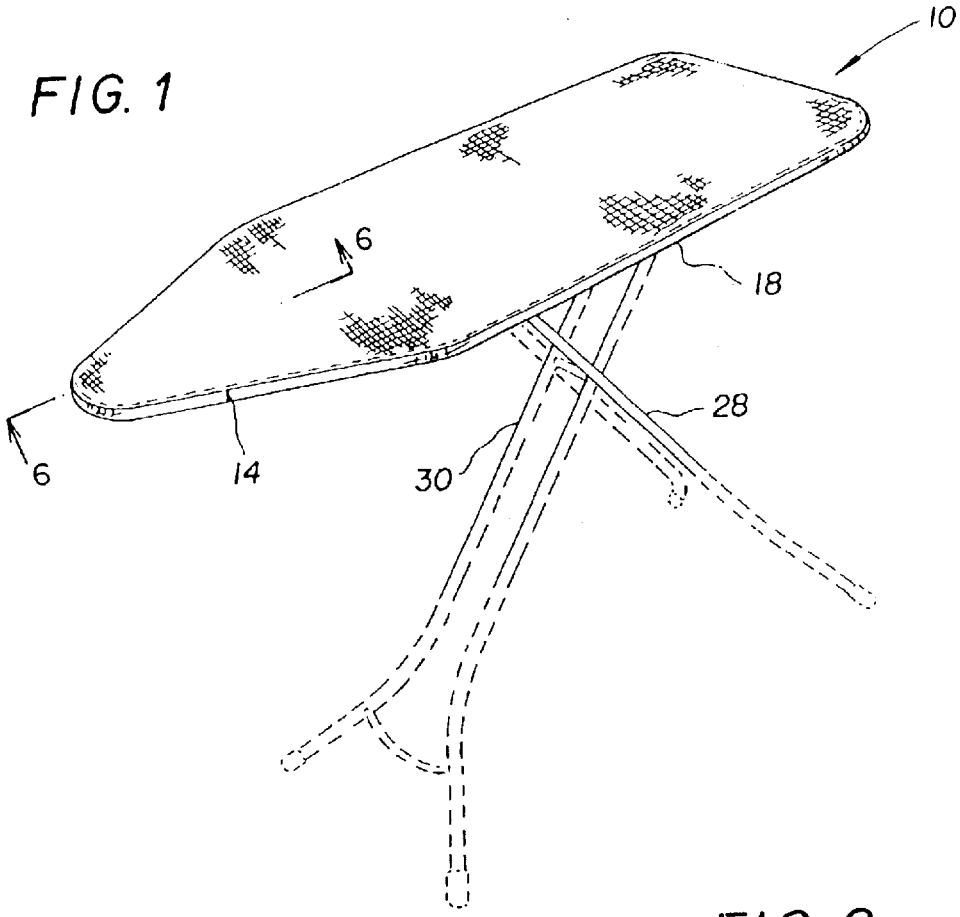
FIG. 1 is a perspective of the novel ironing board cover constructed in accordance with the invention.

The invention provides for two separate anchoring mechanisms along with a dual nose pocket to accommodate the anchoring of ironing board pads of varying widths to fasten said ironing board pads to the ironing board cover and for anchoring the ironing board pad and ironing board cover to the ironing board. In the preferred application of the invention, the ironing board cover is sewn to the ironing board pad as consumers have come to expect an ironing board cover sewn to the ironing board pad. Notwithstanding consumer preference, the invention features a first anchoring mechanism which is a traditional drawstring and a second independent anchoring mechanism which includes a least two separate straps capable of independent placement in a variety of positions around the perimeter of the first anchoring system.

Referring now to FIGS. 1–6, the novel ironing board cover 10 is illustrated having a substantially rectangular configuration terminated in a tapered nose 12. The novel ironing board cover 10 includes a typical drawstring 14 having a fastening means 16 for tightening and tensioning the drawstring 14 around the perimeter 50 of the ironing board 18. The drawstring 14 may be either elastic or inelastic cord or rope of a synthetic or natural material.

Figure 2:
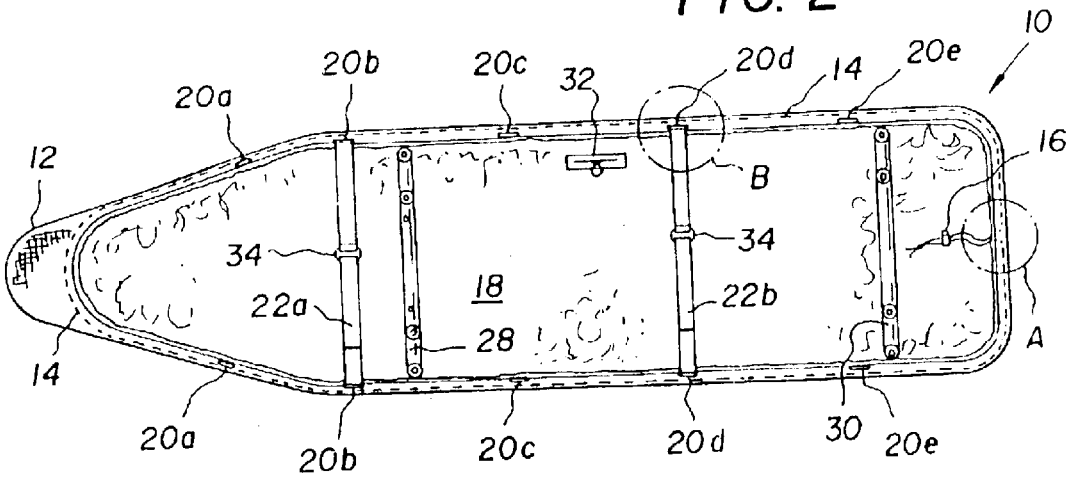
FIG. 2 is a bottom plan view of the novel ironing board cover of FIG. 1.
Figure 3:
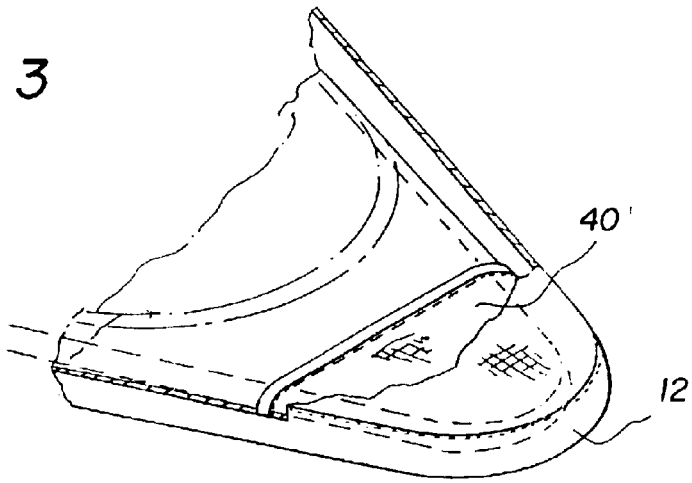
FIG. 3 is a perspective view of the nose portion of the novel ironing board cover of FIG. 1.
Figure 4:
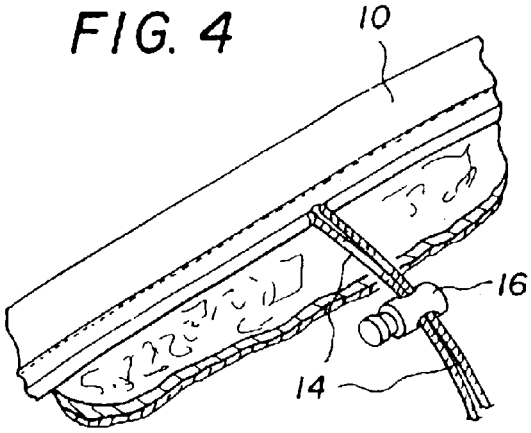
FIG. 4 is perspective view of the circled portion A of FIG. 2.

The novel ironing board cover 10 in the preferred embodiment includes a plurality of alternative openings 20(*a*), 20(*b*), 20(*c*), 20(*d*) and 20(*e*) disposed around the periphery of the ironing board cover 10. The alternative openings 20(*a*) through 20(*e*) along with independently placeable straps 22(*a*) and 22(*b*) provide a second anchoring means for anchoring the ironing board cover 10 to ironing board 18. The plurality of alternative openings 20 may be any number from 20(*a*) through 20(*c*) to 20(*a*) through 20(*j*) and preferably are five alternative openings 20(*a*) through 20(*e*) as illustrated in FIG. 2. The plurality of alternative openings 20 are preferably disposed laterally adjacent to one another for accommodating independently placeable straps 22(*a*) and 22(*b*) at a variety of locations around the perimeter of the novel ironing board cover 10. The plurality of alternative openings 20 in combination with independently placeable straps 22(*a*) and 22(*b*) allow the two separate anchoring systems, one provided by drawstring 14 and the other provided by the plurality of alternative openings 20 and independently placeable straps 22(*a*) and 22(*b*), provide a second anchoring means to accommodate a wide variety of ironing board shapes and configurations having a wide variety of alternative designs for support mechanisms or legs and activation mechanisms for activating the support mechanisms or legs. Typically, adjustable ironing board legs are adjusted by a slotted rack and track arrangement that should not be interfered with by the independently placeable straps.

Figure 7:
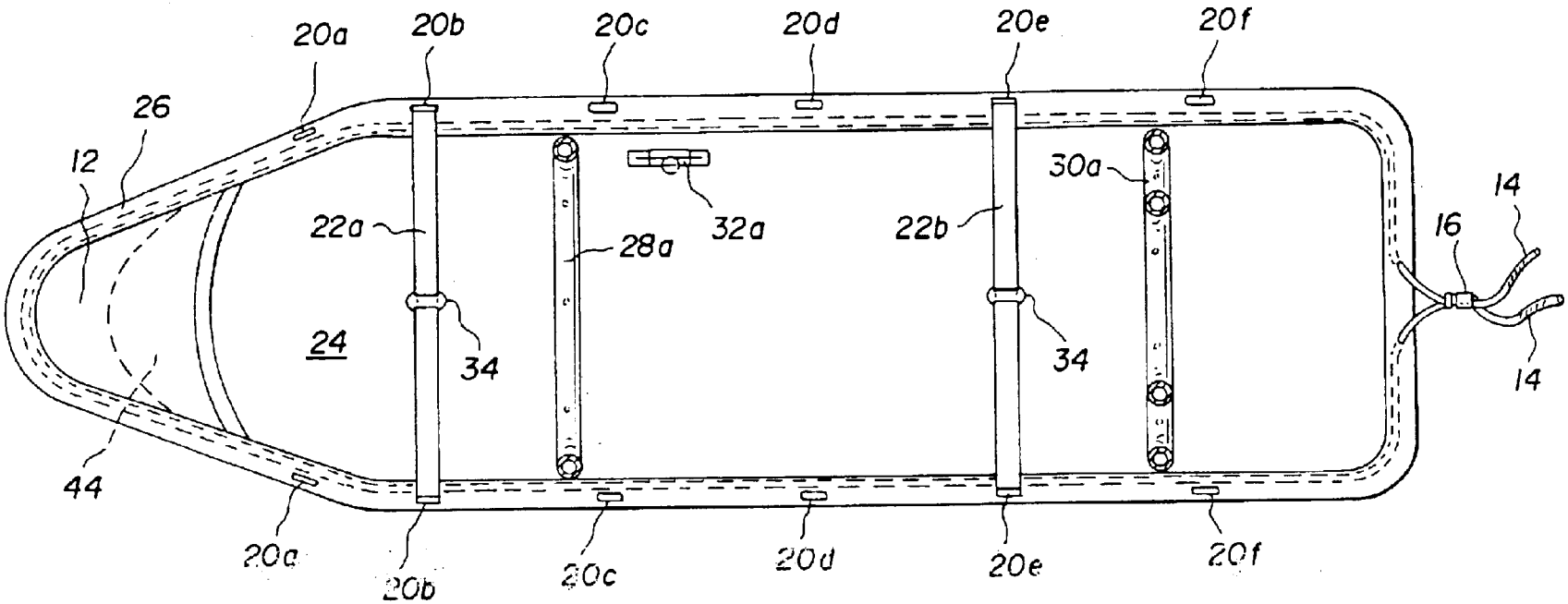
FIG. 7 is an alternative-shaped ironing board illustrating the adaptability of the novel ironing board cover of the invention.

Referring now to FIGS. 1, 2 and 7, ironing board 18 in FIG. 1 and FIG. 2 is of a generally different geometrical design than ironing board 24 in FIG. 7. Ironing board 24 (FIG. 7) includes a nose 26 that is far more blunt than nose 12 of ironing board 18. Further, the beginning of the taper of ironing board 18 and the beginning of the taper of ironing board 24 are different in that the taper tapers at a different location. In addition, the position of the foldable support legs 28 and 30 of ironing board 18 are at different location than foldable support legs 28(*a*) and 30(*a*) of FIG. 7. Furthermore the activation and adjustment mechanism 32 for support legs 28 and 30 on ironing board 18 is different than the activation and adjustment mechanism 32(*a*) of FIG. 7. Notwithstanding the difference in shape and arrangement of support legs 28 and 28(*a*) and 30 and 30(*a*) and the placement of adjustment mechanisms 32 and 32(*a*) on ironing boards 18 and 24 in FIG. 2 and FIG. 7, a novel universal ironing board cover 10 accommodates both as well as a wide variety of ironing board designs. More particularly, as illustrated in FIGS. 2 and 7, one of the independently placeable straps 22(*a*) is placed in the second pair of the plurality of alternative openings 20(*b*) to anchor a novel ironing board cover 10 to ironing board 18, while a second independently placeable strap 22(*b*) is placed in openings 20(*d*) in FIG. 2, and openings 20(*e*) in FIG. 7, to anchor the novel universal ironing board cover 10 to ironing board 18 after the first independent anchoring means consisting of drawstring 14 and fastening means 16 are drawn around the perimeter of the ironing board to anchor the novel ironing board cover to ironing board 18. In this arrangement, the second tensioning means does not interfere with support legs 28(*a*) and 30(*a*) or adjustment mechanism 32(*a*). In the case of the ironing board 24 of FIG. 7, independently placeable strap 22(*a*) is placed in openings 20(*a*) and independently placeable strap or connector 22(*b*) is placed in openings 20(*e*) to anchor the novel ironing board cover 10 to ironing board 24 and avoid interfering with support legs 28(*a*) and 30(*a*) and adjustment mechanism 32(*a*). In view of the alternative locations, 20(*a*) through 20(*f*), and the ability for the independently placeable straps 22(*a*) and 22(*b*) to bridge openings in a variety of positions and locations, including those not directly laterally adjacent, the novel universal ironing board cover provides an anchoring means that accommodates a wide variety of ironing board shapes and configurations having support legs 28 and 30, as well as adjustment mechanisms 32 in a variety of positions in FIG. 2.

Figure 5:
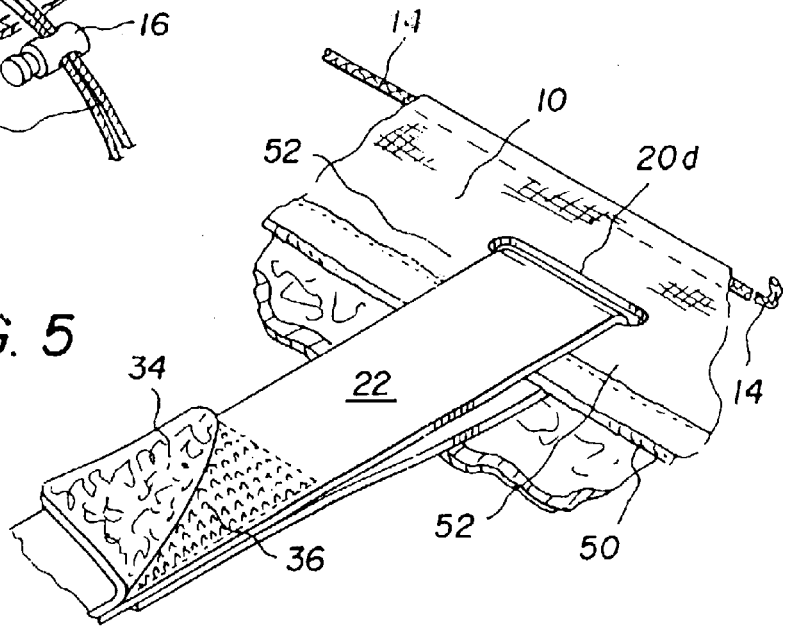
FIG. 5 is a perspective view of the circled portion B of FIG. 2.
Figure 6:
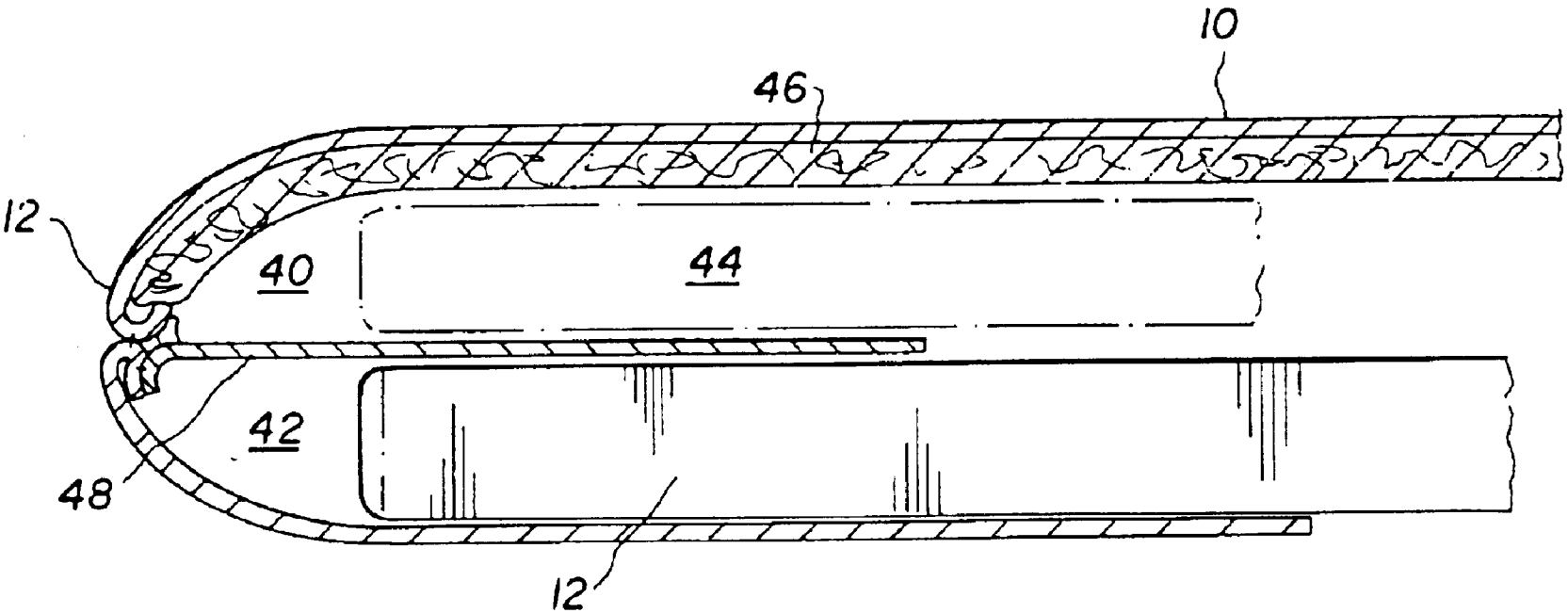
FIG. 6 is a cut-away elevational view of the novel ironing board cover taken along the line 6—6 of FIG. 1.

Referring now to FIGS. 1, 2 and 5, the plurality of independently placeable straps 22 may include a tensioning buckle or strap 34, which in the preferred embodiment includes a VELCRO™ fastener 36 for assisting in the tensioning of the independently placeable straps 22 in the openings 20(*d*). The independently placeable straps may be made of fabric or elastomeric material to assist in the tensioning of the independently placeable straps and anchoring of the novel ironing board cover to the ironing board. In addition, the drawstring 40 may also either be elastic or non-elastic cord for anchoring the ironing board cover to the perimeter of the ironing board. The combination of a plurality of side openings, along with two or more independent tensioning straps allows the straps to be placed in a position that will not interfere with the legs in either the closed or extended positions or the leg activating and adjustment mechanisms as they are being used to allow adjustment of the legs back and forth through the closed to the extended position without interference from the independently placeable straps. This allows the novel ironing board cover the ability to anchor firmly onto an ironing board of varying designs, particularly relating to varying positions of the leg and leg activation and support mechanisms. The plurality of alternative openings are disposed intermediate said drawstring and the distal body 52 of said flexible cover.

Referring now to FIGS. 1, 2, 3 and 6, the novel universal ironing board cover includes a novel multifunctional dual nose pocket having inner and outer nose pocket for securely anchoring the ironing board pad to the ironing board utilizing the novel ironing board cover 10. The novel ironing board cover 10 includes an inner pocket 40 and an outer pocket 42 which inner pocket 40 and outer pocket 42 may be utilized to accommodate either or both the ironing board pad nose 44 and the nose 12 of the ironing board. The inner pocket 40 for receiving the nose 12 of the ironing board or the nose 44 of the ironing board pad is formed by the outer layer 46 of ironing board cover 10 and a partition 48 to form the inner pocket 40. The outer pocket 42 is formed from between the outer layer 46 and the partition 48. The utilization of the inner pocket 40 and outer pocket 42 also serves to anchor the ironing board pad nose 44 to the novel ironing board cover which is then anchored to the ironing board utilizing the two separate adjustable fastening means heretofore discussed. Alternatively, on rare occasions where inner pocket 40 is too small to accommodate pad nose 44, outer pocket 42 can also be used to accommodate the nose of ironing board pad nose 44 when the pad is wide and/or sewn into outer pocket 42 of the ironing board cover 10 which outer pocket 42 can then also accommodate the nose 12 of the ironing board when ironing pad nose 44 is too wide to fit within inner pocket 40.

Figure 8:
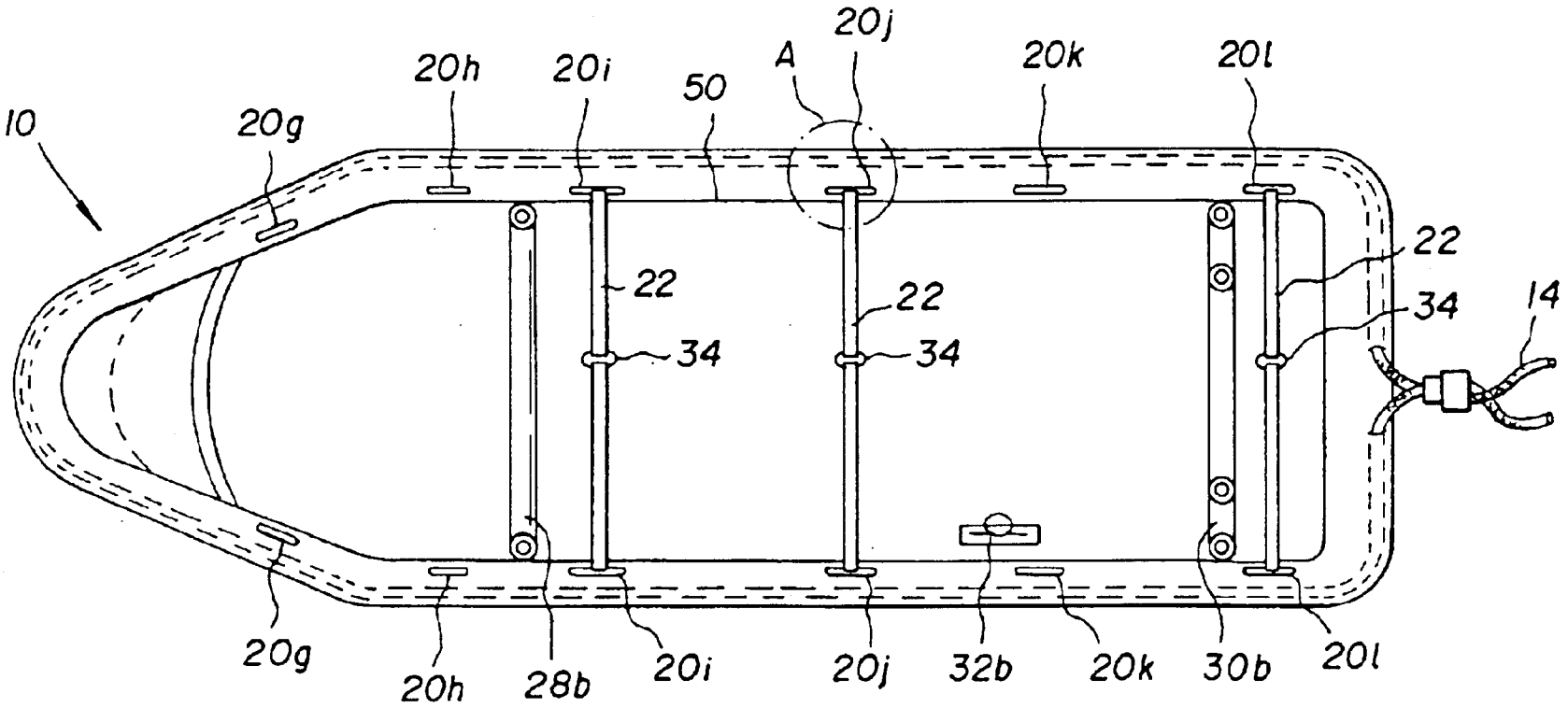
FIG. 8 is an alternative embodiment of the novel ironing board cover illustrating an alternative embodiment for the second tensioning system of the novel ironing board cover of the invention.
Figure 9:
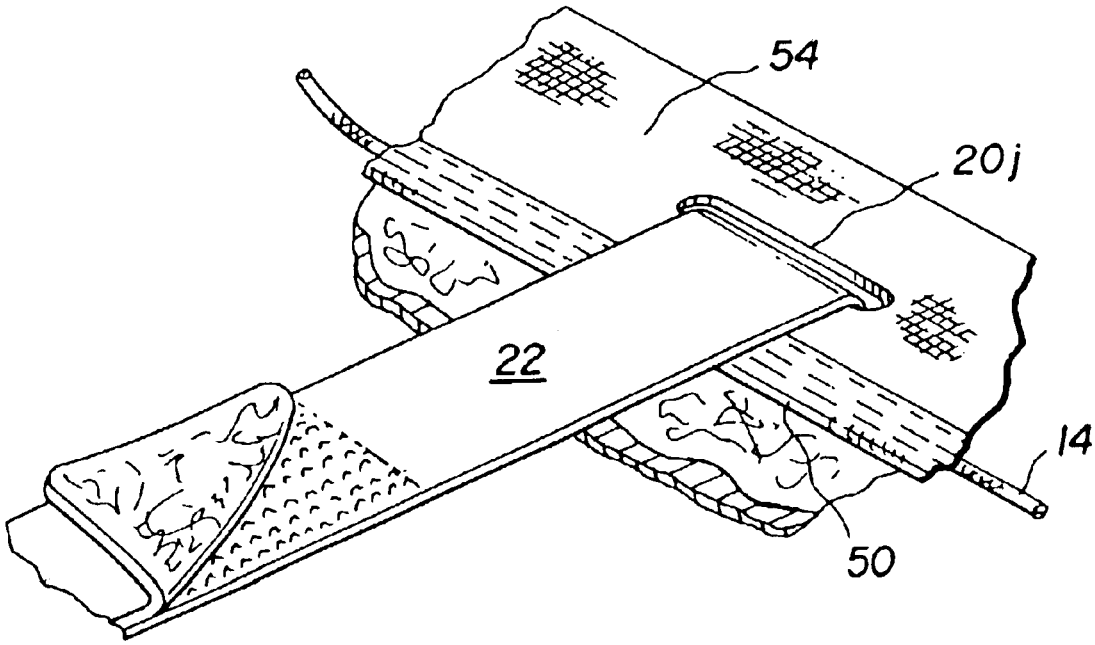
FIG. 9 is a perspective view of the circled portion A of FIG. 8.

Referring now to FIGS. 8 and 9, the novel universal ironing board cover 10 may utilize the second anchoring means inside or outside the perimeter of the drawstring 14. In either case, the independently placeable straps 22 should not contact or interfere with the first tensioning option provided by drawstring 14 or support legs 28(*b*) and 30(*b*) or adjustment mechanism 32(*b*). The independently placeable straps 22 should be substantially perpendicular to perimeter 50. The independently placeable straps 22 may include a tensioning buckle or strap 34. As a result, the independently placeable straps 22 do not contact drawstring 14 and are placed apart from drawstring 14 to engage an opening 20(*g*) through 20(*l*) away from drawstring 14 as illustrated in FIGS. 8 and 9. The two independent tensioning systems provided by the drawstring 14 and the second anchoring system provided by the plurality of alternative openings 20(*g*) through 20(*l*) and the plurality of independently placeable straps 22 provide separate anchoring means for anchoring the novel universal ironing board cover to an ironing board having a variety of shapes and configurations as well as placement of ironing board support mechanisms and mechanisms for adjustment the support mechanisms. In FIG. 8, the plurality of alternative openings can be disposed in other than lateral opposing pairs. In FIG. 9, the drawstring 14 is disposed in a flexible channel disposed intermediate the perimeter 50 of said flexible cover and the proximal body 54 of said flexible cover.

Figure 10:
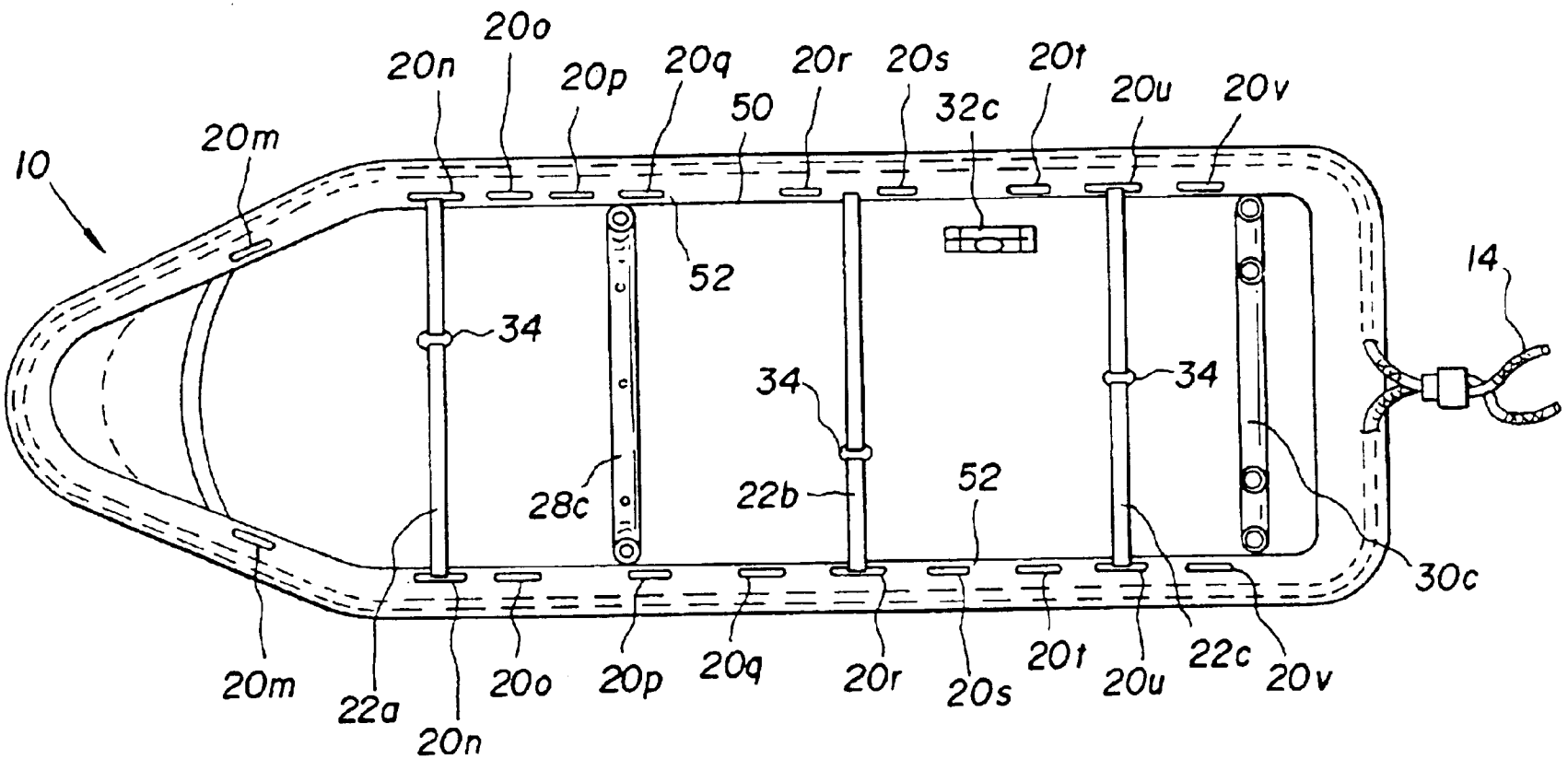
FIG. 10 is an alternative embodiment of the novel ironing board cover illustrating an alternative embodiment for the second tensioning system of the novel ironing board cover of the invention.

Referring now to FIG. 10, the novel universal ironing board cover 10 may utilize the second anchoring means proximal or distal to the flexible channel of the drawstring 14. In either case, the independently placeable straps 22(*a*), 22(*b*) and 22(*c*), which may include a tensioning buckle or strap 34, should be substantially perpendicular to perimeter 50 and should not contact or interfere with the first tensioning option provided by drawstring 14 or support legs 28(*c*) and 30(*c*) or adjustment mechanism 32(*c*). As a result, the independently placeable straps 22 do not contact drawstring 14 and are placed apart from drawstring 14 to engage an opening 20(*m*) through 20(*v*) away from drawstring 14 as illustrated in FIG. 10. The two independent tensioning systems provided by the drawstring 14 and the second anchoring system provided by the plurality of alternative openings 20(*m*) through 20(*v*) and the plurality of independently placeable straps 22 provide separate anchoring means for anchoring the novel universal ironing board cover to an ironing board having a variety of shapes and configurations, as well as placement of ironing board support mechanisms and mechanisms for adjustment the support mechanisms. In FIG. 10, the plurality of alternative openings are disposed intermediate said drawstring 14 and the distal body 52 of said flexible cover. In FIG. 10, the plurality of alternative openings can be disposed in other than lateral opposing pairs.

The novel universal ironing board cover, as a result accommodates ironing boards having a variety of shapes and configurations, as well as the position of the legs and mechanisms used to open, close and adjust the position of the legs. The novel invention provides for alternative tensioning of the ironing board cover by providing a plurality of alternative openings along with independently placeable straps to allow the straps to be placed in a plurality of alternative positions so that the first and second anchoring mechanism for anchoring the ironing board cover to the ironing board are positioned to allow unhindered movement of the legs or leg activation mechanisms. The plurality of alternative openings can be from as few as three pairs to as many as ten pairs that can be disposed in other than lateral opposing pairs; the preferred embodiment is five alternative openings disposed in lateral opposing pairs.

The novel ironing board cover farther allows for the anchoring of an ironing board pad in an inner pocket provided in the novel ironing board cover to anchor the ironing board cover to the ironing board to provide a more secure anchoring of the ironing board cover, as well as the ironing board pad within the ironing board cover to prevent shifting and movement of the ironing board pad with respect to the novel ironing board cover and ironing board, both in positions of storage as well as during use.

It will be recognized that the invention has a wide range of applicability and adaptability in providing a second tensioning system for providing a plurality of alternative positions for anchoring the novel ironing board cover to the ironing board utilizing both a drawstring and a second independent anchoring means. It will be recognized that elastic materials as well as ordinary fabric or rope may be utilized for both the drawstring as well as the anchoring straps. It will further be recognized that changes and modifications may be made in the arrangement and application of various types of fastening means for fastening and tensioning the independently placeable straps with respect to the ironing board cover and that the shape and configuration of the plurality of alternative openings may be moved to suit particular requirements by increasing or decreasing the number of holes or changing the configuration of the openings. These and other changes and modifications as may be made by those skilled in the art are included in the following claims.

What is claimed is:

1. An article of manufacture comprising:

(a) a flexible cover capable of conforming to a substantially flat configuration having a tapered nose portion;

(b) a first independent anchoring system for anchoring said flexible cover to an ironing board formed by a drawstring disposed adjacent the perimeter of said flexible cover;

(c) a second independent anchoring system provided by at least two independently disposable connectors for connecting an alternative pair of a plurality of alternative openings disposed around the perimeter of said flexible cover; and (d) an inner pocket and an outer pocket in said tapered nose portion.

2. The article of claim 1 wherein said at least two independently disposable connectors are composed of an elastomeric material.

3. The article of claim 2 wherein said at least two independently disposable connectors are straps.

4. The article of claim 3 wherein said straps include a tensioning buckle.

5. The article of claim 3 wherein said straps include a hook and loop-type fastener.

6. The article of claim 1 wherein said plurality of alternative openings are at least ten (10) in number.

7. The article of claim 1 wherein said plurality of alternative openings are disposed intermediate said drawstring and said perimeter of said flexible cover.

8. The article of claim 1 wherein said plurality of alternative openings are disposed intermediate said drawstring and the proximal body of said flexible cover.

9. A universal ironing board cover comprising:

(a) a flexible cover having a tapered nose portion and a body portion capable of conforming to a substantially flat configuration;

(b) a drawstring disposed in a flexible channel disposed intermediate the perimeter of said flexible cover and the proximal body of said flexible cover;

(c) a plurality of alternative openings disposed intermediate said drawstring and said perimeter of said flexible cover; and (d) a pair of independent anchoring means for independently bridging a first pair of said alternative openings and a second pair of said alternative openings, wherein said plurality of alternative openings facilitate the placement of said independent anchoring means at a variety of locations along the underside of the ironing board.

10. The universal ironing board cover of claim 9 further comprising an inner pocket in said tapered nose portion.

11. The universal ironing board cover of claim 10 wherein said drawstring includes a tensioning locking means.

12. The universal ironing board cover of claim 11 wherein said drawstring is composed of an elastomeric material.

13. The universal ironing board cover of claim 10 wherein said pair of independent anchoring means are a pair of straps.

14. The universal ironing board cover of claim 13 wherein said pair of independent anchoring means are composed of an elastomeric material.

15. The universal ironing board cover of claim 14 wherein said pair of independent anchoring means include a fastener.

16. A board cover article of manufacture comprising:

(a) a flexible cover material having a tapered nose end with an outer pocket capable of being placed over an ironing board;

(b) an inner pocket disposed within said outer pocket for receiving an ironing board pad;

(c) a drawstring disposed in a channel adjacent the perimeter of said flexible cover; and (d) an anchoring system independent of said drawstring having a plurality of alternative openings disposed adjacent said channel and at least a pair of independent anchoring means for laterally bridging at least two pairs of said alternative openings.

17. The board cover article of claim 16 further comprising a third independent anchoring means.

18. The board cover article of claim 16 wherein said plurality of alternative openings is disposed intermediate said drawstring and said perimeter of said flexible cover.

19. The board cover article of claim 18 wherein said plurality of alternative openings are at least five (5) pair of alternative openings.

20. The board cover article of claim 16 wherein said plurality of alternative openings are disposed laterally adjacent.

21. A universal ironing board cover comprising:

(a) a cover for covering the surface of the ironing board;

(b) a drawstring disposed in a channel disposed intermediate the perimeter of said cover, said drawstring having first tensioning means for tensioning said drawstring around the periphery of said cover;

(c) a plurality of alternative openings disposed intermediate said drawstring and said perimeter of said flexible cover; and (d) a pair of independent anchoring means for independently bridging a first pair of said alternative openings and a second pair of said alternative openings, said independent anchoring means including second tensioning means for tensioning said anchoring means in said alternative openings, wherein said first tensioning means and said second tensioning means function independently of each other during a respective tensioning operation.

* * * * *